United States Patent [19]

Mueller

[11] 4,269,465

[45] May 26, 1981

[54] SPLICE CONNECTOR FOR ALUMINUM WIRE

[75] Inventor: Arthur L. Mueller, Camp Hill, Pa.

[73] Assignee: AMP Incorporated, Harrisburg, Pa.

[21] Appl. No.: 108,731

[22] Filed: Dec. 26, 1979

[51] Int. Cl.[3] ..... H01R 4/36

[52] U.S. Cl. ..... 339/95 R; 339/248 R; 339/272 R

[58] Field of Search ..... 339/95 R, 248 R, 272

[56] References Cited

U.S. PATENT DOCUMENTS

| | | | |
|---|---|---|---|
| 1,103,749 | 7/1914 | Finkelstein | 339/248 R |
| 1,266,441 | 5/1918 | Finkelstein | 339/248 R |
| 1,336,290 | 4/1920 | Finkelstein | 339/248 R |
| 2,953,771 | 9/1960 | Kussy | 339/272 UC |
| 3,124,409 | 3/1964 | Nisula | 339/272 UC |
| 3,727,171 | 4/1973 | Coles et al. | 339/22 B |
| 3,836,941 | 9/1974 | Izraeli | 339/95 R |
| 3,864,013 | 2/1975 | Levy | 339/272 A |

FOREIGN PATENT DOCUMENTS

| | | | |
|---|---|---|---|
| 2141348 | 3/1973 | Fed. Rep. of Germany | 339/95 R |

*Primary Examiner*—John McQuade
*Attorney, Agent, or Firm*—Allan B. Osborne

[57] ABSTRACT

The present invention relates to a connector for electrically joining two aluminum wires, end to end, and further to mechanically retain such wires against pull-out. More particularly, the invention teaches extruding an aluminum tube having a first longitudinally extending passage, a second passage beneath the first passage and vertical slot between the two which create cantilever beams which are resilient so as to exert force against the wires in cooperation with set screws bearing in against the wires from an opposite side of the tube. Further, an elongated tooth slide bar, occupying the vertical slots, provides oxide scrapping action and wire retention, also in cooperation with the set screws.

3 Claims, 4 Drawing Figures

SPLICE CONNECTOR FOR ALUMINUM WIRE

BACKGROUND OF THE INVENTION

1. Field of the Invention

The connection of the present invention relates to the art of electrically and mechanically joining two wires or conductors, and more specifically, those made of aluminum.

2. The Prior Art

Prior art patents relating to the complex problem of satisfactorily joining aluminum wire include U.S. Pat. Nos. 3,892,459 and 3,878,318. While each of these disclosures have added to the art of terminating aluminum wire, the knowledge of terminating such wire is still increasing with the result that even more reliable electrical and mechanical terminations are being achieved.

One well known problem with aluminum wire is that material's ease in creeping under temperature cycling, an environmental condition all electrical connections are subjected to. A second problem is the ease in which the aluminum acquires an oxide coating. As is known, this coating inhibits conductivity. Whereas other problems exist, the two noted above are the most serious.

The two prior art patents listed above represent only a small part of the art and clearly is not meant to be inclusive. They are noted simply as examples of different techniques workers in the field have developed.

3. Summary of the Invention

The present invention is a connector for splicing a pair of aluminum wires together in end to end fashion. An elongated tube has a first longitudinally extending passage into which the wires are inserted. A second, paralleling passage below the first and a slot cut through the dividing wall forms two, opposing cantilever beams. A toothed bar is positioned in the second passage and extends into the slot. Set screws, located in the tube drive the wires against the beams, deflecting them downwardly and also against the teeth on the bar to scrape the aluminum oxides on the wires. The deflected beams retain a memory for their original position so that they continuously exert a force against the wires.

DESCRIPTION OF THE INVENTION

Figure 1:
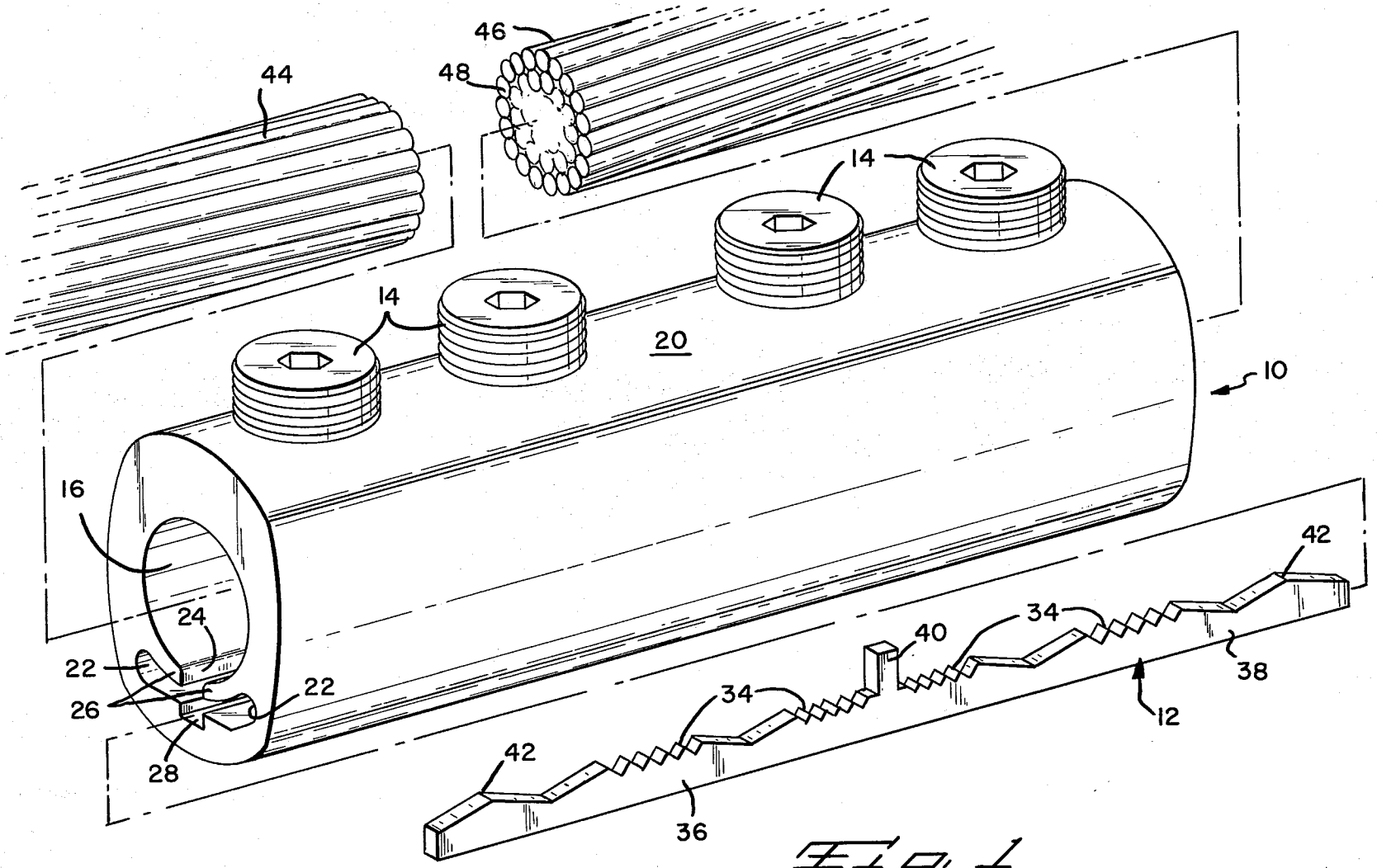
FIG. 1 is a perspective view of the preferred embodiment of the present invention.

The preferred embodiment of the present invention as shown in the figures consists of tube 10, slide bar 12 and set screws 14. With reference to FIG. 1, tube 10 is the elongated member that has a first, relatively large circular passage 16 extending longitudinally completely therethrough. Four threaded holes 18 (FIG. 3) are provided in the upper section or wall of the tube, indicated by reference numeral 20. These holes pass through the wall to intersect passage 16. As the drawings indicate, the holes are grouped together in sets of two with each set located on either side of the tube's transverse center line. The four set screws are threadedly positioned in these holes.

Figure 4:
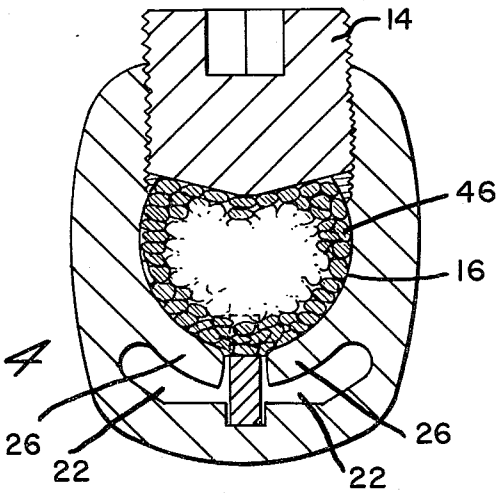
FIG. 4 is a transverse cross-sectional view taken along lines 4—4 in FIG. 2.
Figure 3:
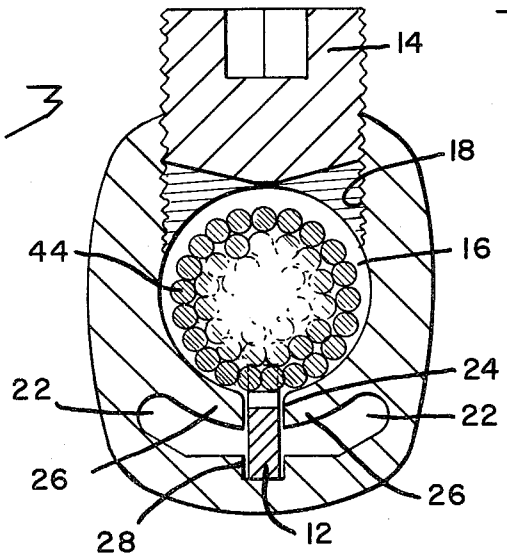
FIG. 3 is a transverse cross-sectional view taken along lines 3—3 in FIG. 2.

With reference to FIGS. 1, 3, and 4, a second passage 22 is positioned below first passage 16 and parallels it throughout the length of the tube.

The wall between the two passages is cut by slot 24 so that two cantilever beams 26 are formed, one facing the other. A second slot 28 is cut into the floor of the second passage.

As can be seen in the drawings, the second passage follows the curvature of the first passage. The distance around the circumference of the first passage determines the length of each beam and of course, the resiliency thereof.

Slide bar 12 is an elongated, stamped bar having a length equal to tube 10, width compatable with slots 24 and 28 and a height such that the teeth 34 thereon just barely reaches the lower surface of passage 16 when the bar is in the tube.

The bar is divided into two identical sections 36 and 38; i.e., one is the mirror image of the other, by a vertical wire stop 40. In addition to teeth 34, a single tooth 42, whose sides are gently sloping, are located adjacent the outer ends of each section. Bar 12 is preferably immovably fixed in the tube although a modification wherein set screws would removably hold it in the slots is within the scope of the present invention.

The components of the present invention are made from aluminum, grade 6061-T6. As is known in the art, this grade aluminum is harder than aluminum used in wires. Tube 10 is preferably extruded to keep costs down. Bar 12 is preferably stamped from coplanar stock for the same reason. The set screws are made by conventional means.

The several drawings include multi-stranded aluminum wires 44 and 46. Only the ends, which have been stripped of insulation (not shown) are pictured.

Splicing the two wires in the connector shown and described above, is simple, straight forward and requires a knife to strip the wire insulation and an Allen wrench (not shown) to turn down the set screws.

The first step is, of course, to remove the insulation from the wire ends. A simple way to cut the right length is to lay one bar section along the wire; i.e., stop 40 being against and mark the insulation wire face 48 where the bar section ends.

Slide bar 12 is then placed in slots 24 and 28 in the tube so that its ends are flushed with the tube ends. Wire stop 40 is then centered within tube 10. Set screws 14 are threaded partly into holes 18 as shown on the left hand side of the tube in FIG. 2 and in FIG. 3.

Figure 2:
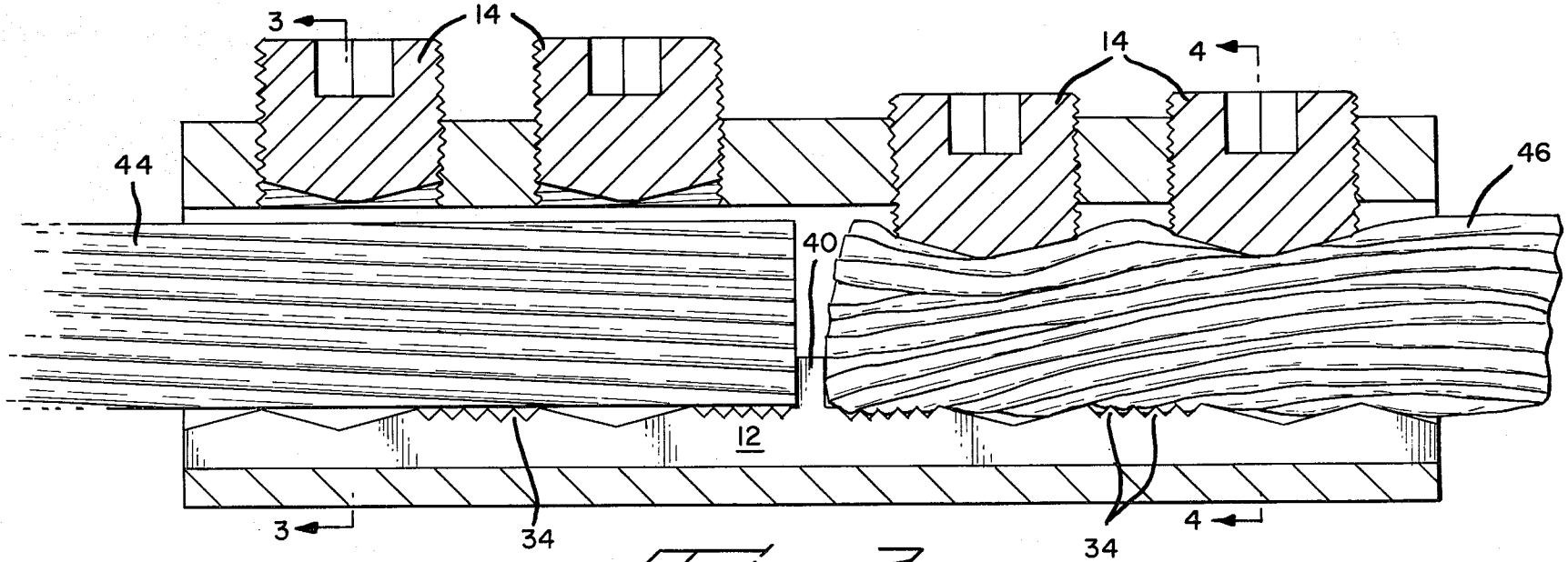
FIG. 2 is an elevational cross-sectional view of the preferred embodiment of FIG. 1 demonstrating how two wires may be spliced together.

The wire ends are next inserted from either end of the tube into passage 16 up to where they abut wire stop 40 (FIG. 2). Set screws 14 are down screwed down tight against the wires as shown in the right hand side of the tube in FIG. 2 and in FIG. 4.

FIG. 2 illustrates on the left hand side the position of the several parts and wire before screws 14 are turned down. The right hand side illustrates the position after the screws are turned down. FIG. 3 is a cross-sectional view of the left hand side and FIG. 4 is the cross-sectional view of the right hand side. Referring first to the left hand side of FIG. 2 and FIG. 3, note that teeth 34 and 42 are just below the wire which is resting on the lower surface of passage 16; i.e., on cantilever beams 26.

After screws 14 are turned down tight against the wires, the condition shown in the right hand side FIG. 2 and FIG. 4 exists. First, in FIG. 2, we see that the wire has been forced onto teeth 34 which caused a scrapping and cutting action on the softer aluminum wire. Oxides are broken up and fresh aluminum metal contact is made between the bar and wire strands. The compressive force of the screws also cause the wire strands to scrape against each other to cause better electrical continuity therebetween.

The end tooth 42 does not cut in as teeth 34. Its function is to provide a strain relief. in this regard, the shape of the bar; i.e., the location of the two sets of teeth 34 on each section and tooth 42 is such as to bracket the points where set screws 14 bear against the wire. Accordingly, the wire is bent at several places so as to make its unintentional withdrawal impossible under ordinary conditions.

The face that aluminum wire creeps under changing thermal conditions requires a force which can fill voids when the wire contracts and which can give way where the wire expands. Cantilever beams 26 provide this requirement. As shown in FIG. 4, these beams are forced down by the pressure being exerted on the wire by screws 14. As can be seen, the initial condition is that not only does the wire fill passage 16, it forces beams 26 into the second passage 22. Upon a contracting condition, wire 46 decreases its size both axially and circumferentially. The space created by the contraction is filled by beams 26 returning towards their original, remembered position. Accordingly, the wire cannot pull out of the tube. Upon an expanding condition, the added space required is provided by the beams moving deeper into the underlying channels.

In summary, a connection is provided which fits the abnormal characteristics of aluminum wire. Further, with the connector being of aluminum also, bi-metallic corrosion is avoided. Special tools are not needed to splice wires in the connector of the present invention. The connector, as constructed in accordance with the preferred embodiment, is economical without a sacrifice in quality.

It is to be understood that the forms of the invention shown and described herein are but preferred embodiments thereof and that various changes and modifications can be made therein without departing from the spirit or scope of the invention.

Reference has been made throughout about using aluminum wire. It should be understood, however, that wire of other material may also be spliced with the connector of the present invention. Also, if copper wire is to be used, the connector can be made from copper. The costs would be higher and manufacturing techniques different but the superior features of the present invention would be available.

I claim:

1. A connector for splicing two electrical wires together, comprising:

a. an elongated tube having a first, wire-receiving passage extending longitudinally therethrough and a second, parallel passage positioned immediately below the first passage, futhermore, a slot cutting longitudinally through the wall between the two passages thereby forming the wall remnants into two cantilever beams running the length of the passages, said tube further having a plurality of threaded openings which intersect the first passage at a location opposite the slot, said threaded openings adapted to receive set screws;

b. a plurality of set screws threadedly positioned in the threaded openings in the tube;

c. an elongated sliding bar of conducting material having a plurality of teeth along one surface positioned within said second passage with the teeth projecting upwardly between the cantilever beams, so that as wires, which may be positioned in the tube, are pushed down by the set screws, the cantilever beams resiliently bend downwardly into the second passage and thereby exert upward pressure on the wires, and the teeth on the sliding bar grip the wires to establish electrical contact and mechanical retention between the wires, the tube and the bar.

2. The connector of claim 1 further including wire stop means on the sliding bar.

3. The connector of claim 2 further including a longitudinally extending slot in the floor of the second passage with the sliding bar being positioned therein.

* * * * *